US009397436B2

(12) United States Patent
Engström et al.

(10) Patent No.: US 9,397,436 B2
(45) Date of Patent: Jul. 19, 2016

(54) ELECTRICAL COUPLING DEVICE FOR A MACHINE

(71) Applicant: Scania CV AB, Södertälje (SE)

(72) Inventors: Jörgen Engström, Grödinge (SE); Mikael Bergquist, Huddinge (SE)

(73) Assignee: SCANIA CV AB (SE)

( * ) Notice: Subject to any disclaimer, the term of this patent is extended or adjusted under 35 U.S.C. 154(b) by 0 days.

(21) Appl. No.: 14/648,954

(22) PCT Filed: Dec. 2, 2013

(86) PCT No.: PCT/SE2013/051423

§ 371 (c)(1),
(2) Date: Jun. 2, 2015

(87) PCT Pub. No.: WO2014/092629

PCT Pub. Date: Jun. 19, 2014

(65) Prior Publication Data

US 2015/0303612 A1 Oct. 22, 2015

(30) Foreign Application Priority Data

Dec. 10, 2012 (SE) ..... 1251397

(51) Int. Cl.
*H01R 13/52* (2006.01)
*H01R 13/42* (2006.01)
(Continued)

(52) U.S. Cl.
CPC ..... *H01R 13/5202* (2013.01); *H01R 13/42* (2013.01); *H01R 13/422* (2013.01); *H01R 13/521* (2013.01); *H01R 13/748* (2013.01)

(58) Field of Classification Search
USPC ..... 439/271
See application file for complete search history.

(56) References Cited

U.S. PATENT DOCUMENTS 3,973,823 A * 8/1976 Stanback ..... H01R 4/62 439/877
4,108,507 A * 8/1978 Renner ..... F16L 5/00 174/153 G (Continued)

FOREIGN PATENT DOCUMENTS

EP 1 541 831 A1 6/2005
FR 2 981 210 4/2013
GB 1463528 A * 2/1977 ..... H01R 13/432

OTHER PUBLICATIONS

International Search Report mailed Mar. 6, 2014 in corresponding PCT International Application No. PCT/SE2013/051423.

*Primary Examiner* — Shelley Chen
(74) *Attorney, Agent, or Firm* — OSTROLENK FABER LLP

(57) ABSTRACT

An electrical connecting device for a machine includes a fitting element (2) to be fitted in an aperture (1*a*) of a wall element (1), at least one connecting element (3) which has a first end (3*a*) with a first connection unit (3*b*) for an electric cable which is situated outside the wall element (1), a second end (3*c*) with a second connecting element (3*d*) for an electric cable which is situated within the internal space, and an intermediate portion (3*e*) to be fitted in an aperture (2*c*) which runs through the fitting element (2); a sealing (5) makes a tight connection between the connecting element (3) and the fitting element (2) in the aperture (2*c*). The fitting element (2) is made integrally from a first material. The connecting element (3) is made integrally from a second material. The connecting element (3) and the fitting element (2) are provided with mutually cooperating surfaces ($2c_1$, $2c_2$, $3e_1$, $3e_2$) which define a predetermined fitting position for the connecting element (3) in the aperture (2*c*).

8 Claims, 3 Drawing Sheets

(51) Int. Cl.
*H01R 13/422* (2006.01)
*H01R 13/74* (2006.01)

(56) References Cited

U.S. PATENT DOCUMENTS 4,955,816 A * 9/1990 Roberts ..... H01R 4/2433 439/358
5,314,341 A * 5/1994 Kazita ..... B60R 16/027 439/15
5,344,330 A * 9/1994 Hoffman ..... B60L 11/1818 439/138
6,485,325 B1 * 11/2002 Fukuda ..... H01R 13/504 439/465
7,494,362 B2 2/2009 Dieterle et al. ..... 439/352
2004/0266269 A1 * 12/2004 Miyazaki ..... H01R 4/46 439/660
2005/0037666 A1 * 2/2005 Konda ..... H01R 31/06 439/607.04
2005/0085102 A1 * 4/2005 Pollock ..... H01R 24/52 439/63
2006/0063412 A1 3/2006 Matsumoto et al. ..... 439/274
2010/0159743 A1 6/2010 Kato et al. ..... 439/587
2010/0261365 A1 10/2010 Sakakura ..... 439/271
2012/0329341 A1 * 12/2012 Morikawa ..... H01R 4/185 439/866
2013/0040505 A1 * 2/2013 Hirakawa ..... H01R 12/721 439/733.1

* cited by examiner

ELECTRICAL COUPLING DEVICE FOR A MACHINE

CROSS-REFERENCE TO RELATED APPLICATIONS

The present application is a 35 U.S.C. §§371 national phase conversion of PCT/SE2013/051423, filed Dec. 2, 2013, which claims priority of Swedish Patent Application No. 1251397-4, filed Dec. 10, 2012, the contents of which are incorporated by reference herein. The PCT International Application was published in the English language.

BACKGROUND TO THE INVENTION AND PRIOR ART

The present invention relates to an electrical connecting device for a machine.

Electrical machines may be cooled by oil which is distributed freely within an internal space of the machine. Such an electrical machine may be situated in a hybrid vehicle in which it serves alternately as a motor and a generator. Electrical machines of this kind need a connecting device which transfers electrical energy between its stator windings situated within the oil-filled space and a source for storage of electrical energy situated outside the oil-filled space. The connecting device has an internal connection for electric cables which are connected to the electrical machine's stator windings and an external connection for electric cables which are connected to the energy storage source. The internal connection is suited to being in contact with oil, whereas the external connection needs to be kept dry and free from oil. Any oil reaching the external connection would make this part of the connecting device difficult to service. Oil also tends to creep in between the conductors and insulation of electric cables. The oil may thus reach the energy storage source and connecting electrical components via the electric cables and cause problems.

EP 1 541 831 refers to an electric motor and a pump situated in a housing which contains hydraulic oil. An electrical connecting device is situated in an aperture of the housing. The connecting device comprises a platelike element fastened in the housing.

The platelike element has three holes for respective contact pins made of electrically conductive material. Each contact pin is fitted on the platelike element by means of a screw-type portion and a nut. The threaded portion and the nut constitute a threaded connection which in a tightened state has also the function of providing a tight connection between the platelike element and the contact pin in the respective hole.

U.S. Pat. No. 7,494,362 refers to a connecting device for transfer of high voltage between an electric cable situated on the outside of a casing of an electric motor unit and an electric cable situated on the inside of the casing. The contact device comprises a connection unit situated in an aperture in the casing. The connection unit comprises a plurality of components, in particular an electrically conductive means, an internal casing and an external casing. The connection unit is provided with an O-ring which serves as a seal in the space between the hole and the connection unit. The connection unit has a threaded portion by means of which it is screwed firmly in a cuplike retainer fastened to the inside of the casing. Such a connecting device is of relatively complicated configuration.

SUMMARY OF THE INVENTION

The object of the present invention is to propose an electrical connecting device for a machine, the device being of relatively simple configuration with few components and which at the same time provides a good seal and is easy to fit.

This object is achieved with the arrangement herein.

The fitting element is thus manufactured integrally from a first material which has, with advantage, good resistance to oil and also has with advantage electrically insulating characteristics. It may be a plastic material with the characteristics indicated above.

The connecting element is manufactured integrally from a second material which has good electrical conductive characteristics. The second material is appropriately a metal material, which may with advantage be brass. The connecting element and the fitting element are configured with mutually cooperating surfaces which define a predetermined fitting position for the connecting element positioned in the hole which runs through the fitting element. Such a solution makes it possible for the connecting element and the fitting element to be fitted in an intended firm fitting position relative to one another in which they are locked together by their shapes. This obviates any need to use separate components for fixing the connecting element and the fitting element in the intended fitting position relative to one another. If the electrical machine is oil-cooled, it is also important to prevent oil from leaking out via the hole which runs through the fitting element. It is therefore appropriate to provide a sealing means between the connecting element and the fitting element in the hole. Because the connecting element is kept in a fixed fitting position in the hole, there will be no relative movements between the connecting element and the fitting element, making it easier to achieve a tight connection with a sealing means. The connecting device according to the invention comprises a small number of components which can be manufactured at low cost. Few components also make the connecting device easy to assemble.

In one embodiment of the invention the fitting element and the connecting element have mutually cooperating surfaces which define a predetermined rotational position for the connecting element within the hole. Providing the intermediate portion of the connecting element and the hole which runs through the fitting element with matching cross-sectional shapes which are not circular in at least one region gives the connecting element a firm rotational position relative to the fitting element. Such a cross-sectional shape may with advantage be semicircular. A semicircular shape results in a planar surface of the connecting element being in contact with a planar surface which defines the hole. The result is two relatively large planar surfaces which ensure that the connecting element is kept in a desired rotational position.

In another embodiment of the invention the fitting element and the connecting element have mutually cooperating surfaces which define a predetermined axial fitting position for the connecting element within the hole. The fitting element is preferably provided with a hole running through it which has a region with a reduced cross-sectional shape. When the connecting element reaches this region, it will not be possible for it to be inserted further into the hole. The mutually cooperating stop surfaces are with advantage situated in a transitional region in which the fitting element and the connecting element change from a circular cross-section to a non-circular cross-section.

In another embodiment of the invention the sealing means is configured to being fitted in a recess which extends round the connecting element. Such a sealing means is with advantage an O-ring. O-rings are annular gaskets made of elastic material. When the connecting element with the O-ring is inserted in the hole, the O-ring is compressed, causing it to exert a pressure on the connecting element and the surfaces which define the hole. A suitably compressed O-ring provides a very good seal in the radial space between the connecting element and the surfaces which define the hole. A further advantage of an O-ring is that said compressive force counteracts any outward movement of the connecting element from the hole. Such a compressive force is often sufficient to keep the connecting element in the intended fitting position in the hole.

In another embodiment of the invention the intermediate portion of the connecting element comprises a region which has a circular cross-section and a region which has a non-circular cross-section. In this case an O-ring may be placed in a recess in the region which has the circular cross-section. The region of the intermediate portion which has the non-circular cross-section will keep the connecting element in a specific rotational position relative to the fitting element when the connecting element has reached the specific fitting position. Such an intermediate portion thus provides a firm rotational position for the connecting element relative to the fitting element while at the same time making it possible to fit an O-ring and achieve good sealing of the hole.

In another embodiment of the invention the ends of the connecting element have connection units in the form of threaded holes which may have an axial extent and have in an end surface at an end of the connecting element an aperture which has a circular cross-section. Each threaded hole may be provided with a radial extent and have in a planar surface at an end of the connecting element an aperture which has a circular cross-section. This makes it easy for an electric cable provided with a suitable cable lug to be screwed firmly into such a threaded hole at the ends of the connecting element by means of a screw. It is however possible to provide the connecting element with substantially any suitable kind of connection unit for electric cables.

In another embodiment of the invention the fitting element has running through it at least two holes to accommodate respective connecting elements. The fitting element preferably has running through it three holes to accommodate respective connecting elements in order to be able to transfer electric current in three phases. It is possible to use only one fitting element which has running through it a number of holes which corresponds to the number of electric cables which are to be connected in the connecting device.

In another embodiment of the invention the connecting element has a housing which encloses the first connection unit and the first end of the connecting element. The connecting components at the first end of the connecting element are thus provided with good protection from dirt, moisture and mechanical deformation. The housing has with advantage an openable or removable cover which may be fastened by screws or the like so as to be easy to remove, e.g. for servicing of the connecting device.

In another embodiment of the invention the housing and the fitting element are manufactured in the form of a composite unit. They may be made of different materials and thereafter be fastened together in a suitable way. They may for example be adhesively bonded together. The connecting element may thereafter be inserted in the hole to the specific fitting position. The connecting device may then be fitted as a unit in the aperture in the wall element. In this case, the connecting device will be very easy to fit.

BRIEF DESCRIPTION OF THE DRAWINGS

Preferred embodiments of the inventions are described below by way of examples with reference to the attached drawings, in which.

DETAILED DESCRIPTION OF PREFERRED EMBODIMENTS OF THE INVENTION

Figure 1:
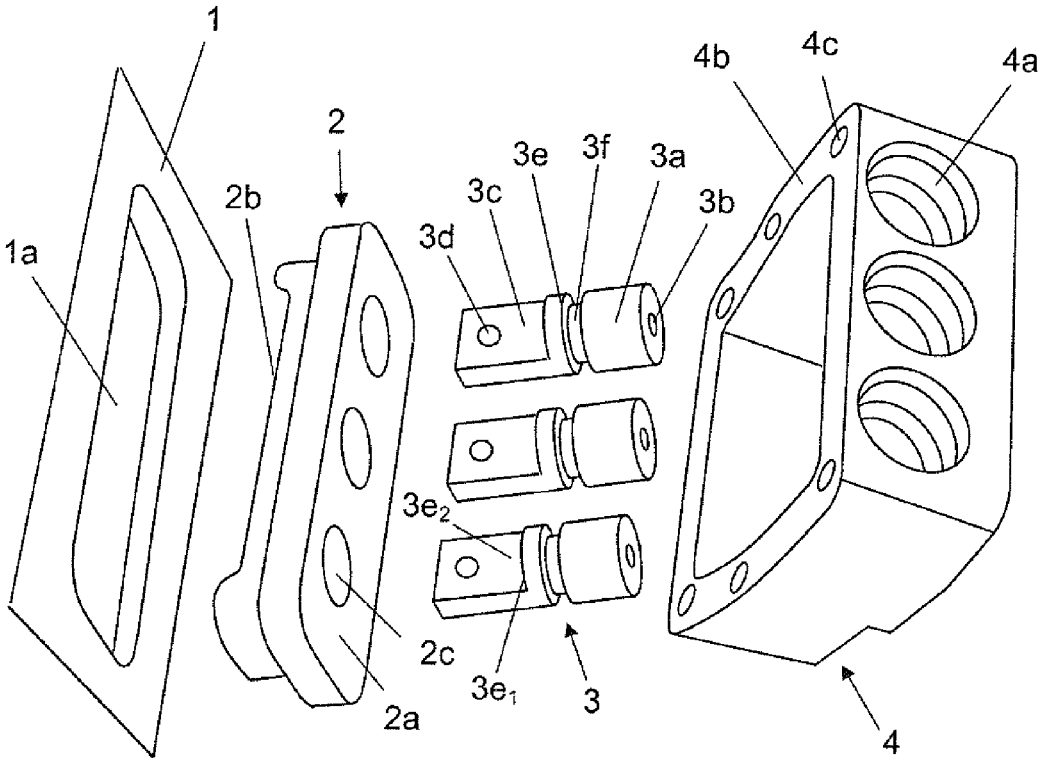
FIG. 1 depicts an electrical connecting device according to a first embodiment of the invention.

FIG. 1 depicts part of a wall element 1 of an electrical machine. The electrical machine is oil-cooled and the wall element defines a closed internal space which contains oil.

Such an electrical machine may be situated in a hybrid vehicle in which it serves alternately as a motor and a generator. An electrical connecting device is adapted to transferring electrical energy, via an aperture 1*a* in the wall element 1, between the electrical machine's windings (not shown) which are situated within the closed space and externally situated electric cables (not shown) which are connected to a hybrid energy store (not shown). The hybrid energy store may comprise a hybrid battery with associated electronic components. The electric cables which are connected to the connecting device, the electrical machine's windings and the hybrid energy store do not appear in drawings, since they do not form part of the connecting device.

The electrical connecting device comprises a fitting element 2 configured to being fitted in the aperture 1*a* in the wall element 1. The shape of the fitting element 2 corresponds to that of the aperture 1*a* so that it fully covers the aperture in the fitted state. The fitting element is made integrally from oil-resistant material with electrically insulating characteristics. The fitting element is with advantage made of plastic material which has these characteristics. The fitting element has a first side 2*a* suited to being located outside the wall element 1, and a second side 2*b* suited to being located inside the wall element 1. The fitting element has running through it three holes 2*c* suited to accommodating respective connecting elements 3 of the connecting device.

Each of the connecting elements 3 is made integrally from an electrically conductive material which may be brass. Each of them has a first end 3*a* which has a cylindrical shape and a circular cross-section. The first end 3*a* is provided with a connection unit in the form of a threaded axial hole 3*b* which has an aperture in an end surface of the first end 3*a*. An undepicted externally situated electric cable provided with a suitably shaped cable lug may be fastened to the end surface by means of a screw or the like. Each of the connecting elements 3 has a second end 3*c* which has a semicylindrical shape and a consequently semicircular cross-section. The second end 3*c* is provided with a connection unit in the form of a threaded radial hole 3*d* which has an aperture in a planar surface $\mathbf{3}e_2$. An undepicted internally situated electric cable provided with a suitably shaped cable lug may be fastened to the planar surface $\mathbf{3}e_2$ by means of a screw or the like. Each of the connecting elements 3 has an intermediate portion 3*e* suited to being situated within the hole 2*c* which runs through the fitting element when the connecting element 3 is in a fitted state. The intermediate portion 3*e* has a region with a circular cross-section and a region with a semicircular cross-section. The intermediate portion 3*e* has an annular depression 3*f* in the circular region to serve as a seat for a sealing means in the form of an O-ring 5. The region with semicircular cross-section comprises part of the planar surface $\mathbf{3}e_2$.

The electrical connecting device also comprises a housing 4 which has an internal space appropriate to enclosing the first end 3*a* and the first connection unit 3*b* of the connecting element 3 and connecting electric cable ends. The housing 4 has three holes 4*a* for leading in the electric cables which are to be connected to the connecting device in the housing. The holes 4*a* are provided with screw-type cable fittings for sealing and electrical screening connections. The housing is provided with a contact surface 4*b* appropriate to coming into contact with the wall element 1 in a fitted state. The housing is provided with holes 4*c* for screws or the like for fitting the housing to the wall element. The electrical connecting device thus comprises a fitting element 2, three connecting elements 3, a housing 4 and three O-rings 5.

Figure 2:
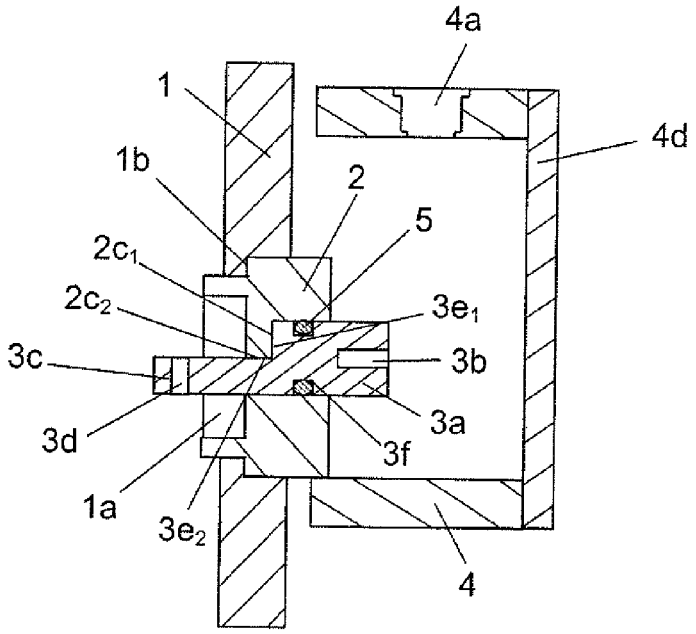
FIG. 2 depicts a vertical cross-section through the connecting device in FIG. 1 in a fitted state.
Figure 3:
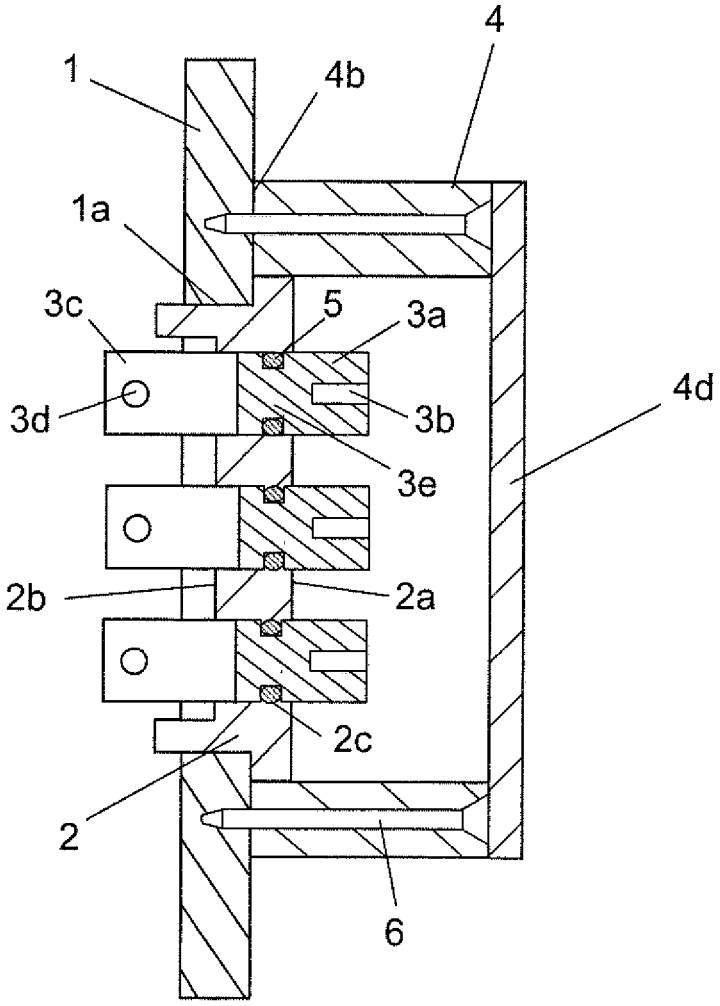
FIG. 3 depicts a horizontal cross-section through the connecting device in FIG. 1 in a fitted state and FIG. 4 depicts an alternative embodiment of the connecting device.

FIG. 2 is a cross-sectional view in a vertical plane through the connecting device when the latter is in a fitted state, and FIG. 3 is a section through the connecting device in a horizontal plane. It may be seen that the holes 2*c* running through the fitting element 2 have a circular cross-section at an aperture in the first side 2*a*. The holes 2*c* have a continuously circular cross-sectional shape up to a stop surface $2c_1$. Thereafter they have a semicircular cross-sectional shape up to an aperture on the second side 2*b*. Each connecting element 3 has a circular cross-sectional shape at the first end 3*a* and a semicircular cross-sectional shape at the second end 3*c*. The intermediate portion 3*e* has a transition between the circular cross-sectional shape and the semicircular cross-sectional shape. The transition is defined by a stop surface $3e_1$.

The electrical connecting device may be fitted in the following way. The fitting element 2 is fastened in the aperture 1*a* of the wall element 1. The wall element has in this case an internal stop surface 1*b* for the fitting element 2 when the latter reaches a desired fitting position in the aperture 1*a*. The stop surface 1*b* may where appropriate be provided with a sealing means to ensure a tight connection between the fitting element and the wall element. The second ends 3*c* of the respective elements 3 are thereafter each inserted in a hole 2*c* which runs through the fitting element, via the apertures on the first side 2*a*. When the connecting element's second end 3*c* reaches the semicircular region of the hole 2*c*, it has to be kept in a specific rotational position to enable it to be inserted further through the hole 2*c*. The connecting element 3 has here to be kept in a rotational position such that its planar surface $3e_2$ will be parallel with a corresponding planar surface $2c_2$ which defines the hole 2*c* where it has a semicircular cross-sectional shape. The connecting element's first end 3*c* may thereafter be inserted further through the hole 2*c* and out on the second side 2*b* of the fitting element. The movement will end when the connecting element's stop surface $3e_1$ reaches the hole's stop surface $2c_1$. The connecting element 3 will then have reached an intended fitting position in the hole 2*c*. In this position the connecting element's second end 3*c* will protrude a suitable distance into the enclosed space defined by the wall element 1, while at the same time the connecting element's first end will be in a desired position outside the wall element 1. The planar surface $3e_2$ of the connecting element and the planar surface $2c_2$ which defines the hole 2*c* will be in contact with one another. The surfaces $2c_2$, $3e_2$ will thus prevent any turning of the connecting element 3. In the fitting position the connecting element may therefore neither be turned nor be inserted further in the hole 2*c*. The O-ring 5 will also exert compressive force on the connecting element 3 and the surrounding surfaces of the fitting element 2. The O-ring 5 will thus provide a good seal so that oil cannot leak out through the hole 2*c*. The compressive force of the O-ring 5 means that a certain amount of force would be required to draw the connecting element 3 back from the specific fitting position. The O-ring 5 thus also helps to keep the connecting element 3 in the specific fitting position.

Finally, the housing 4 is fastened to the wall element 1 by means of screws 6 placed in the holes 4*c*. The housing has an openable cover 4*d* which is with advantage fastened to the housing by means of undepicted screws or a suitable snap device. When the cover is in place, the housing 4 serves as a tight enclosure for the connecting element's first end 3*a* and connecting cable ends. The connections of the connecting device to the external electric cables may thus be protected from dirt, moisture and mechanical action.

Figure 4:
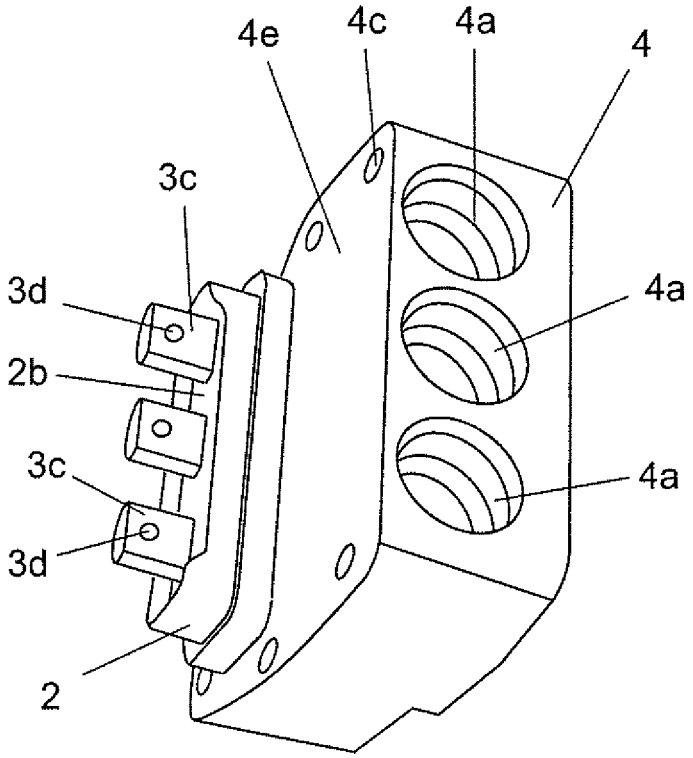

FIG. 4 depicts an alternative embodiment of the connecting device. In this case the fitting element 2 and the housing 4 constitute a preassembled unit. The housing has in this case an internal wall 4*e*. The connecting element 3 is thereafter fitted in the fitting element 2. In this case the connecting device may be fitted as a composite unit in an aperture 1*a* in a wall element 1 of an electrical machine and be fastened by means of screws placed in the holes 4*c*.

The invention is in no way limited to the embodiments to which the drawings refer, but may be varied freely with the scopes of the claims.

The invention claimed is:

1. An electrical connecting device for a machine:

the machine comprising a wall element which separates an internal space of the machine from surroundings of the machine;

the wall element has a hole therethrough;

the connecting device comprises a fitting element configured to fit in the aperture of the wall element;

at least one connecting element having a first end with a first connection unit for connecting to an electric cable which is situated outside the wall element, a second end with a second connecting element for connecting to an electric cable which is situated within the internal space, and an intermediate portion located and configured to being fitted in an aperture through the fitting element, and a seal in the hole configured to make a tight connection between the connecting element and the fitting element;

the connecting element and the fitting element are provided with mutually cooperating surfaces which define a predetermined fitting position for the connecting element in the hole; and the intermediate portion of the connecting element has a first region with a circular cross-section and including a recess which extends around the connecting element;

a seal fitted in the recess, the intermediate portion has a second region with a non-circular cross-section, wherein a transitional portion between the circular cross-section and the non-circular cross-section of the intermediate portion of the connecting element comprises a first stop surface for mutually cooperating with a second stop surface of the fitting element which define a predetermined axial fitting position for the connecting element within the aperture.

2. An electrical connecting device according to claim 1, wherein the non-circular cross-section of the intermediate portion of the connecting element comprise surfaces mutually cooperating with surfaces of the fitting element which define a predetermined rotational position of the connecting element within the aperture.

3. An electrical connecting device according to claim 1, wherein the seal is an O-ring.

4. An electrical connecting device according to claim 1, wherein the first and second ends of the connecting element have respective connection units comprised of threaded holes therein.

5. An electrical connecting device according to claim 1, further comprising at least two of the apertures passing through the fitting element and configured to accommodate respective connecting elements.

6. An electrical connecting device according to claim 1, further comprising the connecting device comprises a housing which encloses the first end of the connecting element and the first connection unit.

7. An electrical connecting device according to claim 6, wherein the housing and the fitting element comprise a composite unit.

8. An electrical connecting device according to claim 1, wherein the fitting element is integrally from a first material, and the connecting element is integrally from a second material.

* * * * *